US005707263A

United States Patent [19]

Eick et al.

[11] Patent Number: 5,707,263

[45] Date of Patent: Jan. 13, 1998

[54] ADJUSTABLE TRIM POSITION SYSTEM

[75] Inventors: Edward C. Eick; Waylon D. Shields; Arthur L. Barker, all of Stillwater, Okla.

[73] Assignee: Brunswick Corporation, Lake Forest, Ill.

[21] Appl. No.: 658,950

[22] Filed: May 31, 1996

[51] Int. Cl.[6] ..... B63H 5/12

[52] U.S. Cl. ..... 440/61

[58] Field of Search ..... 440/49, 53, 57, 440/61

[56] References Cited

U.S. PATENT DOCUMENTS

| | | | |
|---|---|---|---|
| 3,285,221 | 11/1966 | North | 115/41 |
| 3,641,965 | 2/1972 | Schmiedel | 115/41 |
| 3,888,203 | 6/1975 | Lohse | 115/41 |
| 3,999,502 | 12/1976 | Mayer | 115/41 |
| 4,050,359 | 9/1977 | Mayer | 92/113 |
| 4,052,952 | 10/1977 | Hale et al. | 115/41 |
| 4,310,320 | 1/1982 | Pitchford | 440/61 |
| 4,318,699 | 3/1982 | Wenstadt et al. | 440/1 |
| 4,490,120 | 12/1984 | Hundertmark | 440/61 |
| 4,836,810 | 6/1989 | Entringer | 440/61 |
| 4,957,457 | 9/1990 | Probst et al. | 440/61 |
| 4,960,398 | 10/1990 | Potratz | 440/53 |
| 4,964,823 | 10/1990 | Newman et al. | 440/61 |
| 5,514,013 | 5/1996 | Rodskier | 440/57 |

OTHER PUBLICATIONS

Power Trim, MerCruiser Service Manual No. 5, Stern Drive Units TR–TRS 90–12935 1085, pp. 5A–1–5E–4, Brunswick Corporation, 1985.

Instruction Manual showing trim blocks, admitted prior art.

*Primary Examiner*—Stephen Avila

*Attorney, Agent, or Firm*—Andrus, Sceales, Starke & Sawall

[57] ABSTRACT

A system for a trimable marine stem drive shifts the trimable range on a conventional hydraulic trim system. The system includes an enlarged cylinder anchor pin hole in the drive shaft housing, an anchor pin smaller in size than the enlarged anchor pin hole located in the drive shaft housing, and a movable trim adjustment insert that is inserted into the enlarged anchor pin hole to secure the anchor pin in a fixed position within the enlarged hole. It is preferred that the enlarged anchor pin hole be a substantially horizontal elongated hole, and that the trim adjustment insert be placed rearward of the anchor pin to position the anchor pin in a forward position, or forward of the anchor pin to locate the anchor pin in a rearward position. The invention shifts the trimable range of the drive, while maintaining vibration isolation characteristics available in conventional hydraulic trim systems.

13 Claims, 2 Drawing Sheets

10
14
18
16
24
30
34
12
3
3
26
22
32
28
20

50A
44A
48A
42A
40A
36A
38A
40A
18A
48A
18
32
18B
46
48B
40B
38B
36B
40B
42B
48B
50B
44B

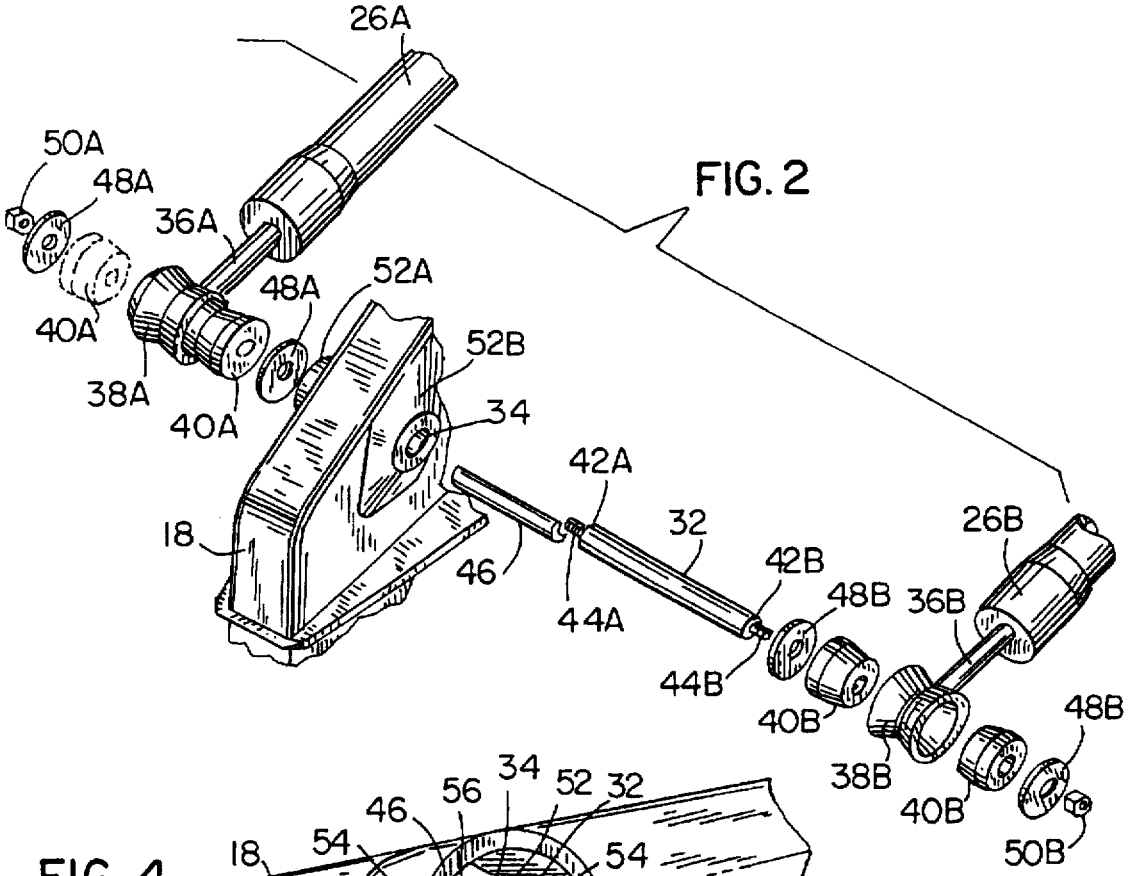
FIG. 2
FIG. 4
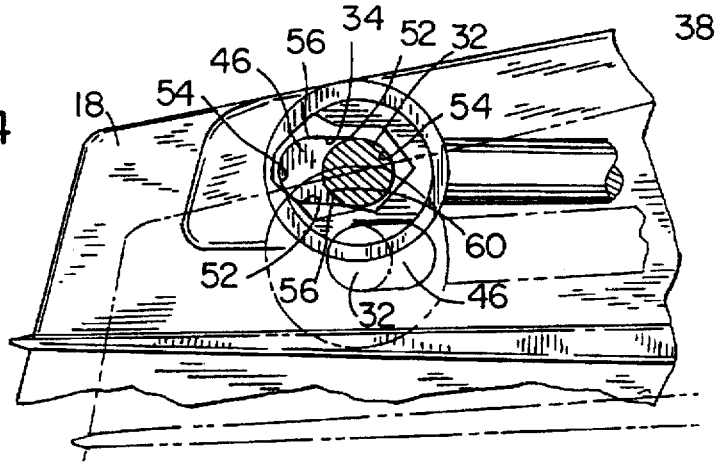
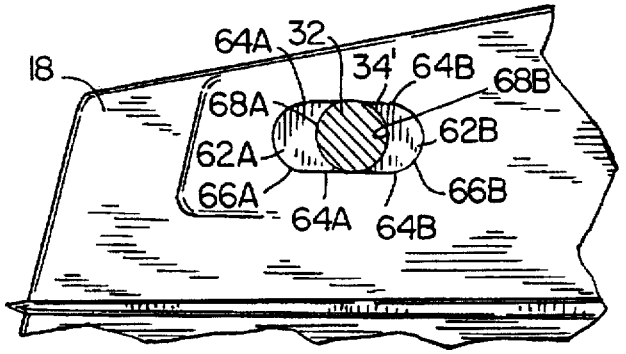
FIG. 5

ADJUSTABLE TRIM POSITION SYSTEM

FIELD OF THE INVENTION

The invention is an adjustable trim position system for a marine stem drive having a hydraulically powered trim system. In particular, the invention shifts the trimable range for a stem drive.

BACKGROUND OF THE INVENTION

In a marine stem drive unit, the engine is mounted inside the boat, and the drive unit is attached to the outside of the transom of the boat. Typically, the drive unit has a drive shaft assembly that is fixed in position relative to the propeller shaft. The drive unit is typically mounted to the transom with a gimbal ring assembly that allows rotation of the drive about a generally horizontal axis to trim the drive, and about a generally vertical axis to steer the boat. While it is possible to manually trim the drive, most stem drives use hydraulically powered trim systems to trim the drive.

In a conventional hydraulically-powered trim system, a pair of hydraulic cylinders are used to power trim the drive about the trim axis. The trim cylinders typically have an internal shock assembly to isolate vibrations. The drive housing has an aft anchor pin hole towards the aft end of the housing. An anchor pin passes through the anchor pin hole so that an end of the anchor pin is present on both sides of the drive housing. A fore end of the starboard side hydraulic cylinder is pivotally mounted to a starboard location on a transom assembly that is lower than the trim axis for the drive and is fixed relative to the transom. The aft end of the starboard side hydraulic cylinder is mounted to the starboard side of the anchor pin. Likewise, a fore end of the port side hydraulic cylinder is pivotally mounted to a port side fixed location that is lower than the trim axis. An aft end of the port side hydraulic cylinder is mounted to the port side of the anchor pin. The trim position of the drive is adjusted by extending or retracting the hydraulic cylinders in unison. The location and range of the trim position is dictated by the location of the anchor pin hole in the drive housing, and the stroke of the hydraulic cylinders.

The trim position of the drive can have a significant effect on the acceleration and performance of a boat. However, it is difficult to select trim settings for a particular hydraulic trim system and model of stem drive that will optimize acceleration and/or performance for a variety of boats and/or applications.

In the past, some boat builders have used trim limit blocks to maintain the drive in a fixed optimum trim-in or down position. However, trim limit blocks tend to create vibration problems when the drive is in gear and in a full down position. Conventional hydraulic trim systems have internal shock assemblies and robber bushings to isolate vibrations. Use of trim limit blocks creates additional vibration problems because of metal to metal contact when the drive is in a full down position.

SUMMARY OF THE INVENTION

The invention is an adjustable trim position system for a trimable marine drive that can easily shift the trimable range for a conventional hydraulic trim system. The adjustable trim position system includes an enlarged anchor pin hole in the drive housing, and a trim adjustment insert that is placed within the hole to adjustably locate the cylinder anchor pin in a fixed position within the anchor pin hole. The invention does not typically change the magnitude of the range of trim positions available for the hydraulic trim system, but rather shifts the range of usable trim positions.

In the preferred embodiment, the enlarged anchor pin hole is a substantially horizontal, elongated hole through the drive shaft housing for the drive. The cylinder anchor pin is located within the substantially horizontal elongated anchor hole so that a starboard end of the anchor pin is present on the starboard side of the outdrive and a port end of the cylinder anchor pin is present on the port side of the outdrive. A trim adjustment insert is inserted in the elongated anchor pin hole either fore or aft of the cylinder anchor pin to adjust the position of the cylinder anchor pin relative to the drive shaft housing. A port side hydraulic trim cylinder has a fore end that is pivotally mounted to a fixed port side location that is lower than the trim axis. The aft end of the port side hydraulic cylinder is mounted to the port end of the cylinder anchor pin. Likewise, the starboard side hydraulic trim cylinder has a fore end that is pivotally mounted to a starboard side fixed location that is lower than the trim axis for the drive. The aft end of the starboard side hydraulic cylinder is mounted to the starboard end of the cylinder anchor pin.

The preferred, elongated anchor pin hole has a cross-section defined by a pair of parallel generally horizontal walls spanning between a pair of spaced apart, outwardly curved, semi-circular end walls. The preferred trim adjustment insert is an elongated rod having a cross-section defined by a pair of parallel generally horizontal surfaces that span between a pair of spaced apart semi-circular end surfaces. The first semi-circular end surface on the trim adjustment insert is outwardly curved, and the second semi-circular end surface on the trim adjustment insert is inwardly curved. The cylinder anchor pin is located between the inwardly curved semi-circular end surface on the trim adjustment insert and one of the outwardly curved semi-circular end walls defining the elongated hole in the drive shaft housing. The length of the pair of horizontal surfaces defining the cross-section for the trim adjustment insert should be the same (or slightly shorter than) as the length of the pair of parallel generally horizontal walls spanning between the semi-circular end walls for the elongated hole.

Another embodiment of the invention uses two trim adjustment inserts. The first trim adjustment insert can be inserted in the elongated anchor pin hole on one side of the cylinder anchor pin and the second trim adjustment insert can be inserted in the elongated anchor pin hole on the opposite side of the cylinder anchor pin thereby defining a central trim position range. If it is desired to shift the trim position range, the second trim adjustment insert can be moved within the elongated hole to be on the same side of the cylinder anchor pin as the first trim adjustment insert, or vice versa.

It is typical for conventional hydraulic trim cylinders to have internal shock assemblies and rubber bushings to isolate vibrations. The invention can be used to easily shift the trim position range without eliminating the vibration isolation characteristics of conventional hydraulic trim cylinders.

Because of the simplicity of the invention, adjustments to the trim positions do not have to be made in the factory. Trim position range can be easily shifted by boat builders, boat dealers, servicemen, or even boat owners. The invention promotes in field trim selection to optimize boat acceleration and/or performance.

While it is preferred that the adjustable trim position system be used in connection with the aft anchor pin hole in the drive housing for a stem drive, the system can also be used in connection with one or more fore anchor pins used to mount the fore end of the hydraulic trim cylinders in a fixed location with respect to the transom.

Other advantages and features of the invention may be apparent to those skilled in the art upon inspecting the drawings and reviewing the following description thereof.

BRIEF DESCRIPTION OF THE DRAWINGS

FIG. 2 is an assembly view of the invention as shown in FIG. 1;

FIG. 4 is a detailed view schematically illustrating use of the invention;

FIG. 5 is a view similar to FIG. 4 illustrating the use of another embodiment of the invention.

DETAILED DESCRIPTION OF THE DRAWINGS

Figure 1:
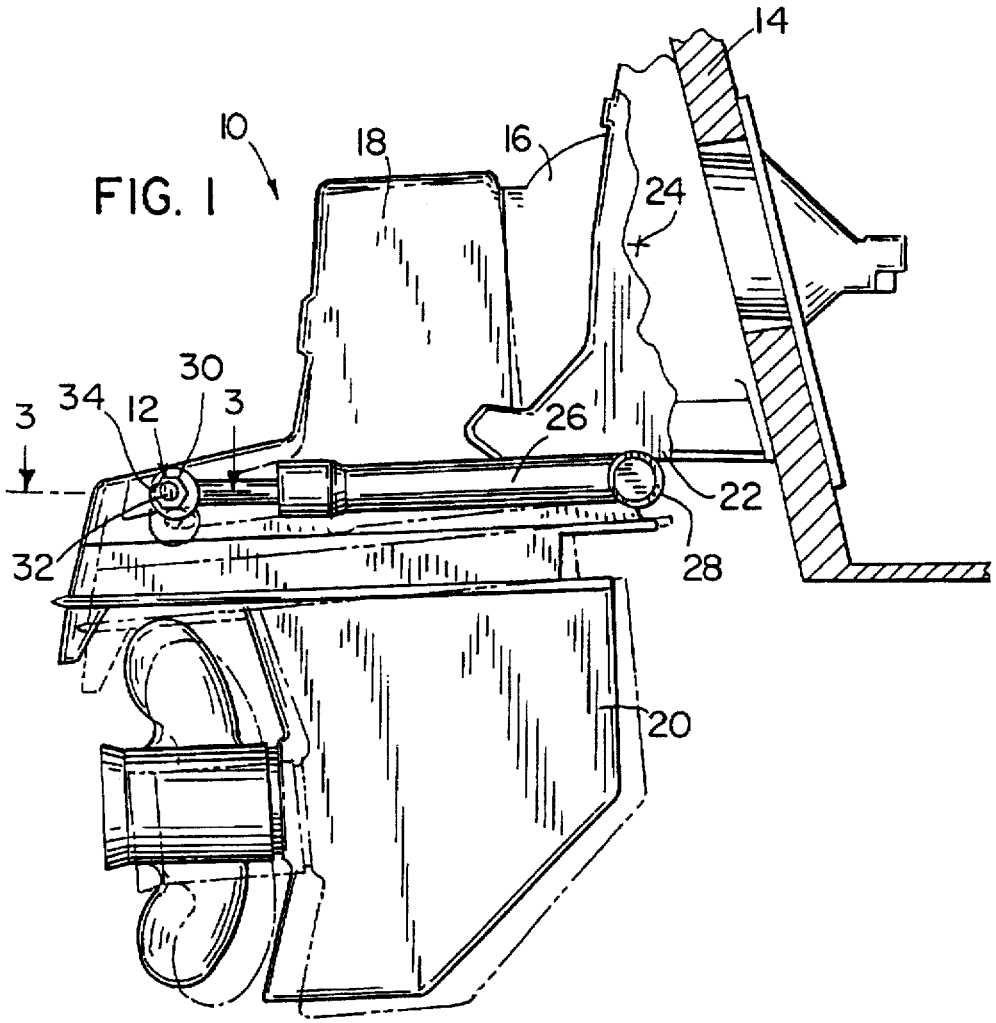
FIG. 1 is a side elevational view of a stem drive having an adjustable trim position system in accordance with the invention.

FIG. 1 illustrates a stem drive 10 having an adjustable trim position system 12 in accordance with the invention. The stem drive 10 is attached to a transom 14 of a boat. The stem drive 10 has a gimbal housing 16, drive shaft housing 18, and a lower gearcase housing 20. A transom assembly 22 having a gimbal ring is attached to the transom 14. The drive 10 is attached to the transom assembly 22. Although not shown in the drawings, it is well known in the art that an output shaft from an engine or an engine transmission located in the boat is coupled to a drive shaft assembly in the drive 10 using a slidable coupler and a U-joint. The drive 10 can rotate about a substantially horizontal trim axis, and can also rotate about a substantially vertical axis to steer the boat. The substantially horizontal trim axis is depicted in FIG. 1 by reference numeral 24.

The stem drive 10 has a pair of hydraulic trim cylinders 26. The hydraulic trim cylinders 26 are preferably powered with a hydraulic pump that supplies pressurized hydraulic fluid to the trim cylinder 26. Each trim cylinder 26 receives a hydraulic fluid supply line and a hydraulic fluid return line. Each trim cylinder 26 preferably has an internal shock assembly as is known in the art (e.g. a spring mechanism mounted to the cylinder piston assembly).

Each of the hydraulic cylinders 26 has a fore end 28 and an aft end 30. Both the fore end 28 and the aft end 30 have a pivot head for mounting the trim cylinder 26. Rubber bushings are used to mount both the fore end 28 and the aft end 30 of the hydraulic cylinder 26. The fore end 28 of the hydraulic cylinder 26 is pivotally mounted to the transom assembly 22 at a location that is lower than the trim axis 24. The aft end 30 of the hydraulic cylinder 26 is mounted to an aft anchor pin 32 adjustably positioned in an enlarged anchor pin hole 34 located in the rear portion of the drive shaft housing 18.

FIG. 2 shows an assembly view of the invention as used with conventional hydraulic trim cylinders **26*a* and 26*b*. The port side hydraulic trim cylinder 26*a* is preferably the same as the starboard side hydraulic trim cylinder 26*b*. Each trim cylinder 26*a*, 26*b* has a piston shaft 36*a*, 36*b* that is connected to a pivot head attachment fitting 38*a*, 38*b*. The pivot heads 38*a* and 38*b* are formed of two frustoconical walls extending outwardly from one another. Rubber bushings 40*a*, 40*b* are assembled within the pivot heads 38*a*, 38*b*. The anchor pin 32 extends through the enlarged opening 34 in the drive shaft housing 18 when the system is assembled. The anchor pin 32 has a port side end portion 42*a* and a starboard side end portion 42*b*. Both the end portions 42*a*, 42*b* for the anchor pin 32 have threads 44*a*, 44*b* extending therefrom. A trim adjustment insert 46 is inserted into the enlarged anchor pin hole 34. The enlarged anchor pin hole 34 passes through a pair of bosses 52*a*, 52*b* extending laterally from the drive shaft housing 18 to lengthen the support area for the cylinder anchor pin 32. Washers 48*a*, 48*b* are used to secure rubber bushings 40*a*, 40*b* in pivot heads 38*a*, 38*b* when the cylinders 26*a* and 26*b* are attached to the end portions 42*a*, 42*b* of the anchor pin 32 using nuts 50*a*, 50*b***.

Figure 3:
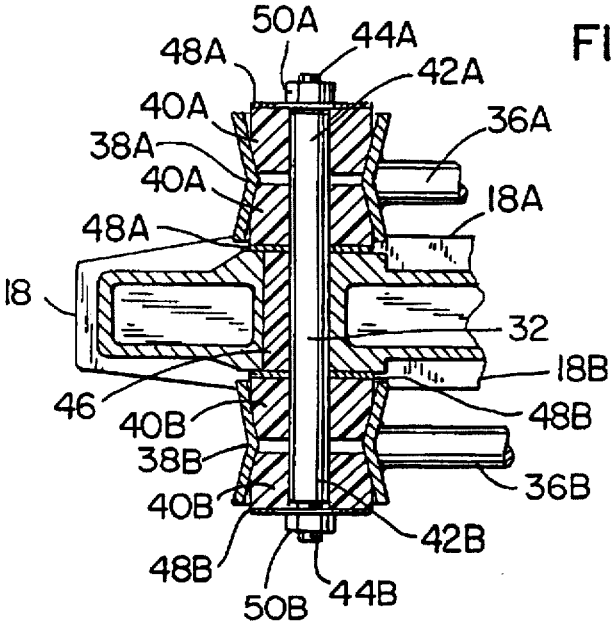
FIG. 3 is a sectional view taken along line 3—3 in FIG. 1.

FIG. 3 shows the adjustable trim position system assembled with the trim adjustment insert 46 positioned rearward of the anchor pin 32, thus positioning the anchor pin 32 in a forward position.

The enlarged anchor pin hole 34 in the drive shaft housing 18 has a cross-section that is substantially larger than the cross-section of the anchor pin 32. The trim adjustment insert 46 is inserted into the enlarged anchor pin hole 34 in the drive housing 18 so that the trim adjustment insert has a surface (surface 60 in FIG. 4) that contacts and complements at least a part of the anchor pin 32 to maintain the anchor pin 32 in a fixed position within the enlarged anchor pin hole 34. The trim adjustment insert 46 is movable upon disassembling the system, and can be repositioned within the enlarged anchor pin hole 34 to adjust the position of the anchor pin 32 within the enlarged hole 34. The preferred enlarged hole 34 is an elongated, substantially horizontal hole 34 having the same height as the diameter of the anchor pin 32. Although the preferred construction involves an elongated substantially horizontal anchor pin hole 34, it should be understood that the invention is not limited to this preferred construction. It should be understood, however, that using an enlarged hole 34 having a different cross-section should be suitable depending on the cross-section of the trim adjustment insert 46.

As shown best in FIG. 4, the preferred cross-section of the elongated hole 34 is defined by a pair of parallel, generally horizontal walls 52 spanning between a pair of spaced apart, outwardly curved, semi-circular end walls 54. The radius of the semi-circular end walls 54 is preferably the same as the radius of the anchor pin 32 (e.g., ⅜ inch radius).

The trim adjustment insert 46 is preferably an elongated rod made of plastic, although other materials may be suitable. The preferred cross-section of the trim adjustment insert 46 is defined by a pair of generally horizontal parallel surfaces 56 spanning between a pair of spaced apart semi-circular surfaces 58, 60. The first semi-circular surface 58 of the insert 46 is outwardly curved. The second semi-circular surface 60 of the insert 46 is inwardly curved. The radius of the semi-circular surfaces 58, 60 for the insert 46 is also preferably the same as the radius of the anchor pin 32. The distance between the center points for the semi-circular surfaces 58, 60 for the trim adjustment insert 46 is preferably about 0.5 inches. The length of the substantially horizontal parallel surfaces 56 on the trim adjustment insert 46 (i.e. the distance between the center points for each of the semi-circular surfaces 58, 60) should be the same as the length of the generally horizontal parallel walls 52 defining the elongated hole 34 in the drive shaft housing 18. The inwardly curved semi-circular surface 60 on the trim adjustment insert 46 contacts and complements the anchor pin 32 so that the anchor pin 32 is secured in a fixed position within the elongated anchor pin hole 34.

FIG. 4 depicts the anchor pin 32 in a forward position, and in phantom in an aft position. By placing the trim adjustment insert 46 forward of the anchor pin 32, the stem drive 10 can be trimmed downward and inward further than when the trim adjustment insert 46 is rearward of the anchor pin 32 (see FIG. 1).

FIG. 5 shows another embodiment of the invention having two trim adjustment inserts 62*a* and 62*b*. In FIG. 5, the length of the elongated anchor pin hole 34' in the drive shaft housing 18 is preferably longer than the elongated anchor pin hole 34 in the embodiment of the invention shown in FIGS. 1–4 using a single trim adjustment insert 46. In FIG. 5, each of the trim pin inserts 62*a* has a pair of parallel, generally horizontal surfaces 64*a*, 64*b* spanning between a pair of spaced apart semi-circular surfaces 66*a*, 66*b* and 68*a*, 68*b*. Semi-circular surfaces 66*a*, 66*b* are outwardly curved, and semi-circular surfaces 68*a*, 68*b* are inwardly curved. The radius of the semi-circular curved surfaces 66*a*, 66*b*, and 68*a*, 68*b* are preferably the same as the radius for the anchor pin 32. The length of the parallel generally horizontal surfaces 64*a*, 64*b* on the trim adjustment inserts 62*a*, 62*b* should be sufficient so that the anchor pin 32 is secured in a fixed position when the unit is assembled, and so that the inwardly curved surfaces 68*a*, 68*b* on the trim adjustment inserts 62*a*, 62*b* contact the anchor pin 32. The geometry of the trim adjustment inserts 62*a*, 62*b* are preferably identical to each other. The system shown in FIG. 5 provides greater flexibility in adjusting the trimable range for the unit than the system shown in FIGS. 1–4. FIG. 5 shows the anchor pin 32 in a central or neutral position. To put the anchor pin 32 in a forward position, trim adjustment insert 62*b* can be placed rearward of the anchor pin 32 in a nesting arrangement with trim adjustment insert 62*a*. Likewise, to put the anchor pin 32 in an aft position, trim adjustment insert 62*a* can be moved forward of the anchor pin 32 in a nesting arrangement with trim adjustment insert 62*b*.

Although not shown in the drawings, it should be apparent to those skilled in the art that the adjustable trim position system can be used in connection with a fore anchor pin or pins used to mount the fore end 28 of the hydraulic trim cylinders 26A, 26B to the transom assembly 28, instead of in connection with the aft anchor pin 32 used to mount the aft end 30 of the hydraulic trim cylinders 26A, 26B to the drive housing 18.

These equivalents and modifications to the invention may be apparent to those skilled in the art without departing from the true spirit of the invention. Such equivalents and modifications should be considered to come within the scope of the following claims.

We claim:

1. An adjustable trim position system for a trimable marine drive comprising:

a drive housing pivotally connected to a transom of a boat for rotation about a generally horizontal trim axis to trim the marine drive, the drive housing having a substantially horizontal elongated hole therein;

a cylinder anchor pin located at least in part within the elongated hole in the drive housing;

a trim adjustment insert that can be placed in the elongated hole either fore or aft of the cylinder anchor pin to adjust the position of the anchor pin relative to the drive housing; and a hydraulic cylinder having a fore end and an aft end, the fore end of the hydraulic cylinder being pivotally mounted at a fixed location that is lower than the generally horizontal trim axis for the drive, and the aft end of the hydraulic cylinder being mounted to the cylinder anchor pin.

2. An adjustable trim position system as recited in claim 1 wherein:

the elongated hole has a cross-section defined by a pair of parallel generally horizontal walls spanning between a pair of spaced apart, outwardly curved, semi-circular end walls; and the trim adjustment insert has a cross-section defined by a pair of parallel generally horizontal surfaces spanning between a pair of spaced apart, semi-circular end surfaces, the first semi-circular end surface being outwardly curved, and the second semi-circular end surface being inwardly curved.

3. An adjustable trim position system as recited in claim 2 wherein the pair of parallel generally horizontal surfaces of the trim adjustment insert has substantially the same length as the pair of parallel generally horizontal walls of the elongated anchor pin hole.

4. An adjustable trim position system as recited in claim 2 wherein a distance between a center point for each of the semi-circular end surfaces on the trim adjustment insert is approximately 0.5 inches.

5. An adjustable trim position system as recited in claim 1 wherein the elongated anchor pin hole extends through the drive housing so that the hole is open on two ends.

6. The invention as recited in claim 1 wherein the marine drive is a stem drive.

7. An adjustable trim position system as recited in claim 1 wherein the drive housing comprises a drive shaft housing and a lower gearcase housing, and the elongated anchor pin hole is located in the drive shaft housing.

8. An adjustable trim position system as recited in claim 1 wherein the fore end of the hydraulic cylinder is pivotally mounted to a transom assembly that is fixed to a transom of a boat.

9. An adjustable trim position system as recited in claim 1 wherein the trim adjustment insert is a first trim adjustment insert and the system further comprises a second trim adjustment insert that can be inserted in the elongated anchor pin hole either fore or aft of the cylinder anchor pin.

10. An adjustable trim position system for a trimable marine stem drive comprising:

a drive housing pivotally mounted to a transom of a boat for rotation about a generally horizontal axis to trim the stem drive, the drive housing having a substantially horizontal elongated anchor pin hole therethrough;

a cylinder anchor pin extending through the elongated anchor pin hole in the drive housing so that a starboard end of the cylinder anchor pin is present on the starboard side of the drive housing and a port end of the cylinder anchor pin is present on the port side of the drive housing;

a trim adjustment insert that can be inserted into the elongated anchor pin hole either fore or aft of the cylinder anchor pin to adjust the position of the cylinder anchor pin relative to the drive housing;

a starboard hydraulic cylinder having a fore end and an aft end, the fore end of the starboard hydraulic cylinder being pivotally mounted to a starboard side fixed location that is lower than the generally horizontal trim axis for the drive, the aft end of the starboard side hydraulic cylinder being mounted to the starboard end of the cylinder anchor pin; and a port side hydraulic cylinder having a fore end and an aft end, the fore end of the port side hydraulic cylinder being pivotally mounted to a port side fixed location that is lower than the generally horizontal trim axis for the drive, the aft end of the port side hydraulic cylinder being mounted to the port end of the cylinder anchor pin.

11. An adjustable trim position system as recited in claim 1 wherein the trim adjustment insert is a first trim adjustment insert and the system further comprises a second trim adjustment insert that can be inserted into the elongated anchor pin hole either fore or aft of the cylinder anchor pin.

12. An adjustable trim position system for a trimable marine drive comprising:

a drive housing pivotally mounted to a transom of a boat for rotation about a generally horizontal axis to trim the marine drive, the drive housing having an enlarged anchor pin hole;

a cylinder anchor pin located at least in part within the enlarged anchor pin hole in the drive housing, the cross-section of the anchor pin being smaller than the cross-section of the enlarged anchor pin hole;

a trim adjustment insert that can be inserted into the enlarged anchor pin hole in the drive housing, the trim adjustment insert having a surface that contacts and complements at least a part of the anchor pin to maintain the anchor pin in a fixed position within the enlarged anchor pin hole in the drive housing; and a hydraulic cylinder having a fore end and an aft end, the fore end of the hydraulic cylinder being pivotally mounted to a fixed location that is lower than the generally horizontal trim axis for the drive, and the aft end of the hydraulic cylinder being mounted to the cylinder anchor pin.

13. An adjustable trim position system for a trimable marine drive comprising:

a transom assembly that is fixed to the transom of a boat, the transom assembly having an enlarged anchor pin hole;

a drive housing pivotally mounted to the transom assembly for rotation about a generally horizontal axis to trim the marine drive;

a cylinder anchor pin located at least in part within the enlarged anchor pin hole in the transom assembly, the cross-section of the anchor pin being smaller than the cross-section of the enlarged anchor pin hole;

a trim adjustment insert that can be inserted into the enlarged anchor pin hole in the transom assembly, the trim adjustment insert having a surface that contacts and complements at least a part of the anchor pin to maintain the anchor pin in a fixed position within the enlarged anchor pin hole in the transom assembly; and a hydraulic cylinder having a fore end and an aft end, the fore end of the hydraulic cylinder being pivotally mounted to the cylinder anchor pin, and the aft end of the hydraulic cylinder being mounted to the drive housing.

* * * * *

UNITED STATES PATENT AND TRADEMARK OFFICE

CERTIFICATE OF CORRECTION

PATENT NO. : 5,707,263

DATED : Jan. 13, 1998

INVENTOR(S) : EDWARD C. EICK ET AL.

It is certified that error appears in the above-indentified patent and that said Letters Patent is hereby corrected as shown below:

In The Claims

Claim 6, Col. 6, Line 28, delete "stem" and substitute therefor ---stern---; Claim 10, Col. 6, Line 43, delete "stem" and substitute therefor ---stern---; Claim 10, Col. 6, Line 46, delete "stem" substitute therefor ---stern---.

Signed and Sealed this

Twenty-third Day of June, 1998

Bruce Lehman

*Attest:*

BRUCE LEHMAN

*Attesting Officer*

*Commissioner of Patents and Trademarks*